US005813356A

United States Patent [19]

Nolle

[11] Patent Number: 5,813,356

[45] Date of Patent: Sep. 29, 1998

[54] SEWING MACHINE WITH TRIMMING DEVICE

[75] Inventor: Wolfgang Nolle, Albstadt, Germany

[73] Assignee: Union Special GmbH, Hemmingen, Germany

[21] Appl. No.: 826,087

[22] Filed: Mar. 24, 1997

[30] Foreign Application Priority Data

Mar. 20, 1996 [DE] Germany ..... 296 15 135.7

[51] Int. Cl.[6] ..... D05B 37/06; D05B 69/02

[52] U.S. Cl. ..... 112/122; 112/220

[58] Field of Search ..... 112/122, 122.1, 112/122.2, 122.3, 122.4, 129, 125, 130, 141, 143

[56] References Cited

U.S. PATENT DOCUMENTS 5,289,789 3/1994 Sakuma ..... 112/122
5,427,041 6/1995 Satoma ..... 112/125

*Primary Examiner*—Peter Nerbun
*Attorney, Agent, or Firm*—Brinks, Hofer, Gilson & Lione

[57] ABSTRACT

In the case of a sewing machine having a cutting means for the purpose of cutting a workpiece edge a disengaging means is provided by means of which an upper cutter is moved out of a working position in which it moves in a reciprocating manner—in dependence upon the rotational movement of a drive shaft—into an inoperative position. In so doing a lower cutter is covered.

11 Claims, 3 Drawing Sheets

SEWING MACHINE WITH TRIMMING DEVICE

BACKGROUND OF THE INVENTION

The invention relates to a sewing machine having a cutting means.

A multi-needle sewing machine having a cutting means comprising a fixed lower cutter and a movable upper cutter for the purpose of cutting a seam folded in a U-shaped manner is known from DE 36 42 573 Al—The upper cutter cuts the workpiece edge by means of the lower cutter on the left side of the needle penetration site prior to stitching, whereupon the workpiece is moved to the stitch forming site where the seam is stitched. When seaming individual workpiece items whose workpiece edge is not to be cut or only to be cut in parts, this cutting means can be of a hindrance because the upper cutter moves up and down immediately in advance of the stitch-forming site.

The object of the invention is thus to design a cutting means in such a manner that it is possible without hindering the operator to stitch the workpiece edge or rather seam which is not to be cut.

By virtue of providing a disengaging means between the drive shaft of the sewing machine and the upper cutter it is now possible in a convenient manner to lower the upper cutter out of a working position, in which it moves in a reciprocating manner, into an inoperative position and for it to remain stationary in the inoperative position. In this manner the workpiece edge can be stitched at least partially without the edge being trimmed.

In one embodiment it is possible in a convenient manner for tubular workpieces to be seamed and cut.

An embodiment of the invention is explained in detail hereunder with reference to the drawing, in which.

Figure 1:
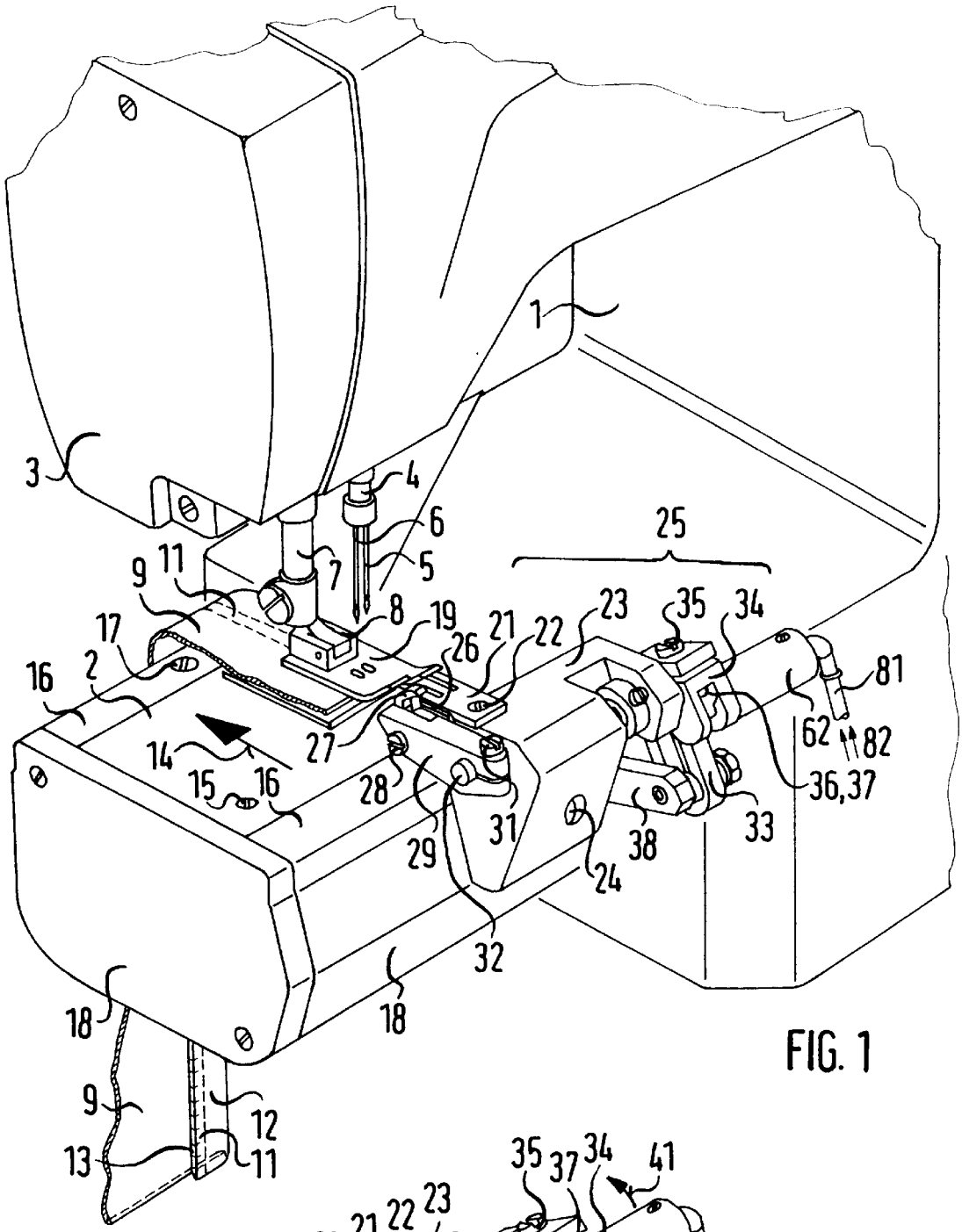
FIG. 1 shows a perspective partial view of a sewing machine having a cutting means with the upper cutter in the working position.

A sewing machine 1, for example a cylinder bed cover seam sewing machine, comprises according to FIG. 1 a workpiece support 2 and an upper part 3 in which a needle rod 4, which is driven in such a manner as to move up and down, supports a right and left needle 5 and 6. A presser foot 8 is attached to a resilient pressure rod 7 which can move up and down and which is disposed behind the needle rod 4. A workpiece 9 lies beneath the presser foot 8 and a U-shaped seam 12 which is folded under is formed on the said workpiece. The edge 13 of the workpiece 9 is secured by a seam 11, e.g. stitch type 401, 406 or 407 according to ISO 4915. The workpiece 9 is fed in a known manner in a workpiece forward feed direction indicated by an arrow 14.

The work piece support 2 is attached by means of a screw 15 to a carrier 16 which is attached by means of a screw 17 to a cylinder arm 18 of the sewing machine 1. The carrier 16 also serves to receive a needle plate 21 provided with a stitch-forming site 19, which needle plate is attached by means of a screw 22 to a support 23 which for its part is attached by means of a screw 24 to the cylinder arm 18.

The support 23 is part of a workpiece edge lower cutter means 25 which can be switched off and which is attached immediately in advance of the left needle 6 in the region of the stitch-forming site 19. The cutting means 25 serves to trim the workpiece edge 13 during the stitching process. This renders it possible to form a seam having an even edge, particularly in the case of an unevenly cut workpiece 9. The support 23 supports a fixedly disposed lower cutter 26 on the left side of which is located an upper cutter 27 (illustrated in the drawing in the upper cutter raised position). The upper cutter 27 is hook shaped and is disposed in such a manner as to be able to move. The upper cutter 27 is attached by means of a screw 28 to an upper cutter holding device 29 which is attached by means of a screw 31 to a shaft 32 which is rotatably mounted in the support 23. A latch lever 33 is connected in an engaged position to a bracket piece 34 which is attached to the shaft 32 by means of a screw 35. A drive surface 36 of the latch lever 33 contacts a counter surface 37 on the bracket piece 34. A connecting rod 38, which is connected in an articulated manner to the latch lever 33, is in FIG. 1 located it its front position. When connecting rod 38 is in its rear position the upper cutter 27 is in the upper cutter raised position.

Figure 2:
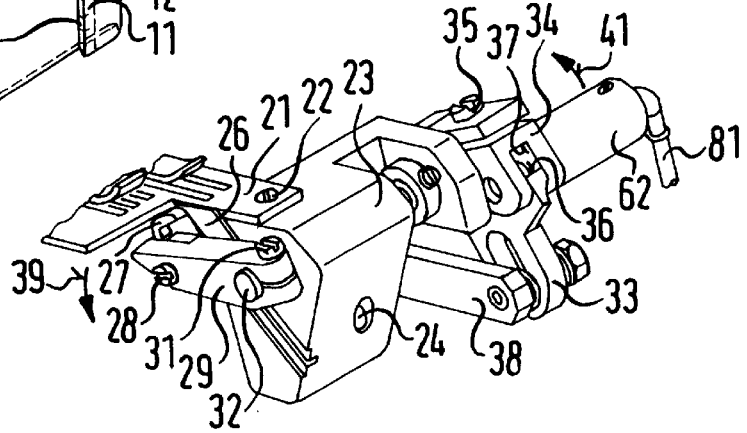
FIG. 2 shows a perspective view of the cutting means with the upper cutter in the inoperative position.

FIG. 2 shows the upper cutter 27 in the lowered inoperative position. In this lowered position the latch lever 33 is connected in an articulated manner to the bracket piece 34. The drive surface 36 of the latch lever 33, in the position illustrated in FIG. 2, is not operatively connected to the counter surface 37 on the bracket piece 34. The connecting rod 38, in FIG. 2 is disposed in its rear position. When connecting rod 38 is in its front position (not illustrated in the drawing) the drive surface 36 contacts the counter surface 37. In this manner it is ensured that the upper cutter 27 is practically stationary in the lowered inoperative position during the stitching process. An arrow 39 illustrates the direction that the upper cutter must move to be in lowered position and the inoperative position of the upper cutter 27. An arrow 41 indicates the raised pivoted position of the bracket 34.

Figure 3:
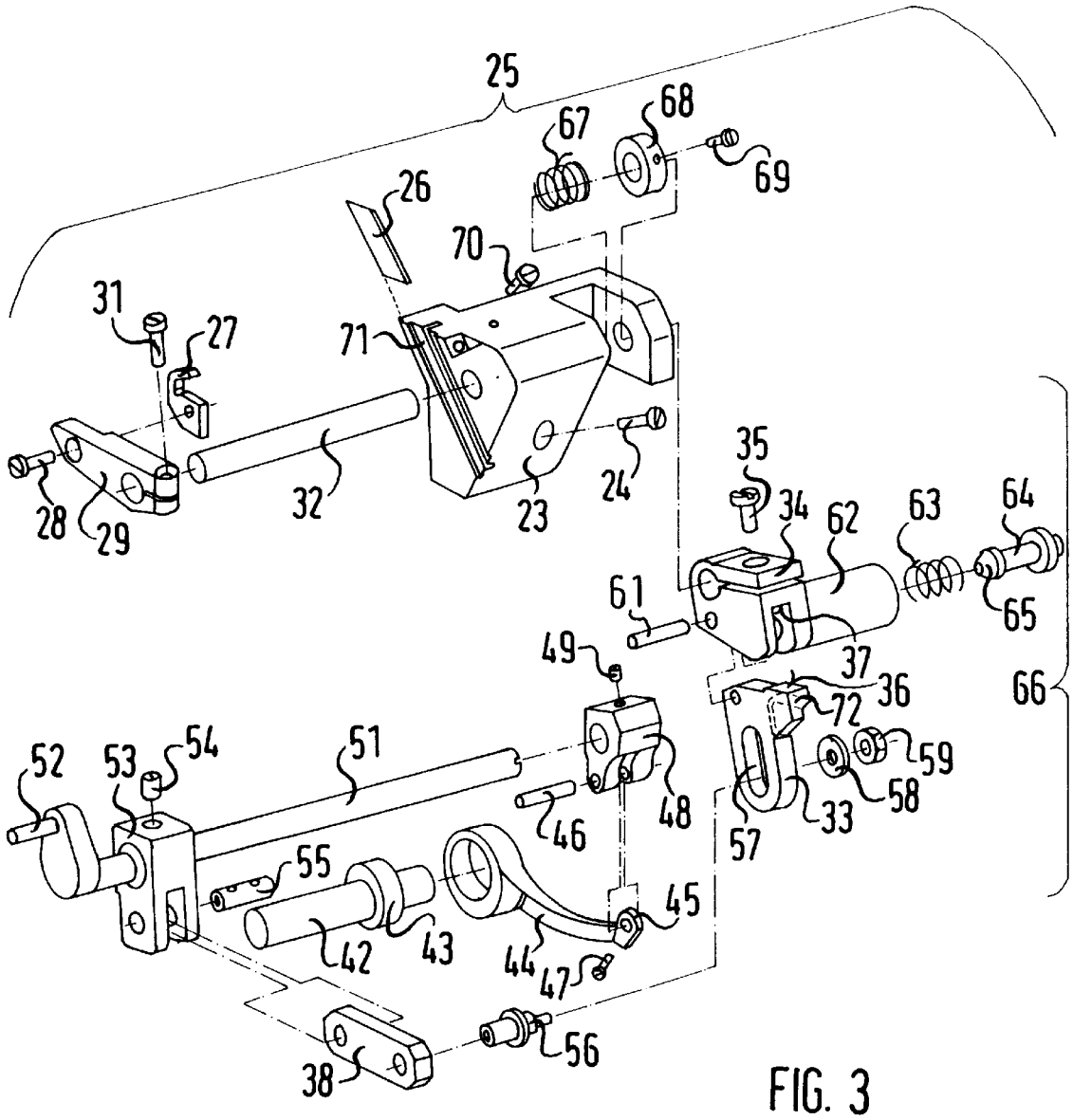
FIG. 3 shows an exploded illustration of the cutting means.

FIG. 3 shows an exploded view of cutting means 25. A drive shaft 42 supports an eccentric 43 which is encompassed by a connecting rod 44 which comprises at its free end an eyelet 45 which supports a pin 46 which is secured by means of a screw 47. The pin 46 is connected in an articulated manner to a lever 48 which for its part is fixedly clamped by means of a screw 49 to a shaft 51. Shaft 51 is rotatably mounted in a known manner in the cylinder arm 18 and by way of an eccentric journal 52 drives a known forward feed mechanism, e.g. the mechanism illustrated in the UNION SPECIAL Class 34700 KF, Catalogue No. 282. The shaft 51 supports a lever 53 which is secured by means of a screw 54 and is connected in an articulated manner to the connecting rod 38 by means of a pin 55.

The connecting rod 38 encompasses a collared rod 56 which penetrates an elongated slot 57 in the latch lever 33 and is secured to the latch lever 33 by means of a disc 58 and a nut 59. The elongated slot 57 renders it possible to adjust the upper cutter stroke since depending upon the position of the collared rod 56 in the elongated slot 57 the effective lever length of the latch lever 33 changes. The latch lever 33 is connected in an articulated manner by means of a pin 61 to the bracket piece 34 which supports a hollow cylinder 62 that receives compression spring 63 and a piston 64 having a conical end 65. The latch lever 33, the pin 61, the bracket 34, the conical end 65 and the compression spring 63 are part of a disengaging means 66.

The lateral cutting pressure between the upper cutter 27 and the lower cutter 26 can be adjusted by means of a compression spring 67 and an adjusting ring 68 which are disposed on the shaft 32. The adjusting ring 68 is positioned on the shaft 32 by means of a screw 69. A screw 70 secures the lower cutter 26 in a receiving device 71 of the support 23.

Figure 4:
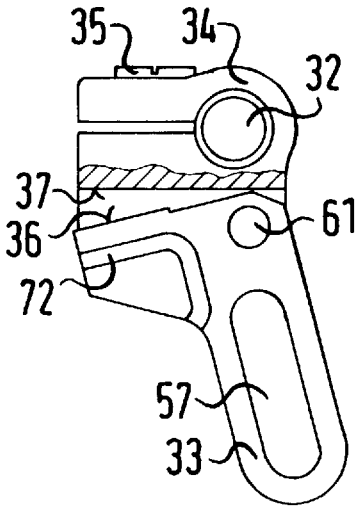
FIG. 4 shows a partial lateral view of a disengaging means.

FIG. 4 shows the latch lever 33 which is articulated on the bracket 34 and is pivoted about the pin 61 and includes a wedge-like surface 72. The bracket piece 34 is partially cutaway, as is indicated by cross hatching.

Figure 5:
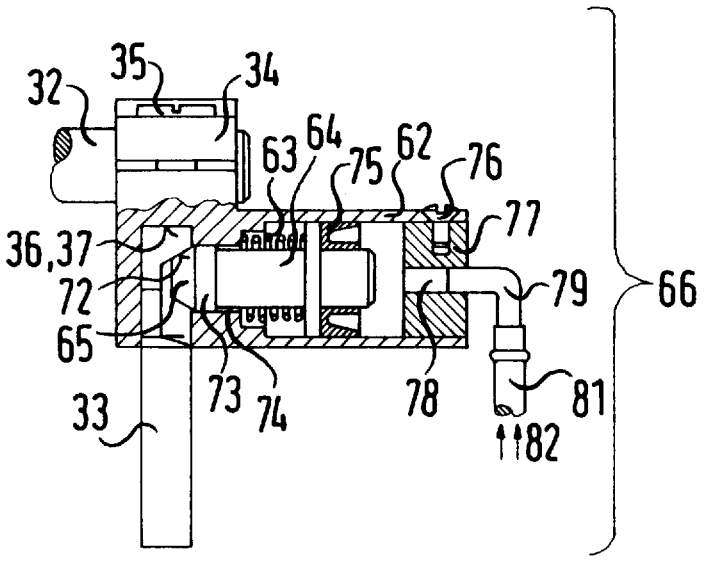
FIG. 5 shows a frontal view of the disengaging means in the engaged state.

FIG. 5 shows the articulated latch lever 33 engaging the bracket piece 34. The contact surface 36 and the counter surface 37 are closed as also illustrated in FIG. 1. The conical end 65 is wedged with the chamfered wedge-like surface 72 of the latch lever 33 and is supported by means of a guide ring 73 in a guide orifice 74 of the hollow cylinder 62 so that the latch lever 33 and the bracket piece 34 function as a one-piece lever. This has the advantage that any bearing play in the pin 61 is compensated for in the bracket piece 34.

The piston 64 supports a sealing collar 75 which is controlled by means of compressed air and as a consequence urges the piston 64 against the effect of the spring 63 into its left end position. A stopper 77 which is secured by means of a screw 76 seals the hollow cylinder 62 and comprises an orifice 78 through which a tubular piece 79 is attached for the purpose of receiving a compressed air hose 81 in which compressed air 82 flows in a controlled manner. A known pneumatic valve (not illustrated in the drawing) renders it possible to actuate the piston 64. In the compressed-air actuated state the conical end 65 engages in the latch lever 33 and wedges itself against the wedge-like surface 72. In the absence of air pressure the conical end 65 does not engage the wedge-like surface 72 since the compression spring 63 urges the piston 64 into its right end position.

The cutting means 25 functions as follows: when the sealing collar 75 is acted upon by compressed air the conical end 65 locks the latch lever 33 with the bracket piece 34. As a consequence with each rotation of the drive shaft 42 the upper cutter 27 moves up and down. It is only essential that the connecting rod 44 which is driven in an eccentric manner is operatively connected to the pivot member, i.e., with the upper cutter holder 29, which causes the cutting movement. In the absence of air pressure acting upon the adjusting member, i.e. the disengaging means 66, the upper cutter 27 automatically changes, as a result of the disengagement of the drive surface 36 and counter surface 37, into its upper cutter lowered position which is its inoperative position. The upper cutter 27 remains stationary owing to the frictional effect of the upper cutter 27 against the lower cutter 26.

I claim:

1. A sewing machine of the type including a drive shaft and other sewing machine components, a cutting means comprising a fixed lower cutter including a cutting edge and a movable, hook shaped, upper cutter including a cutting edge, said movable upper cutter is disposed when in a working position adjacent to said lower cutter and movable in a path that causes its cutting edge to raise above and cross the cutting edge of said fixed lower cutter, and which upper cutter is drivingly connected to said drive shaft of the sewing machine for the purpose of trimming a workpiece edge of a folded seam, characterized in that a disengaging means is provided between said drive shaft and said upper cutter, said disengaging means functioning, upon being actuated, to move the upper cutter out of its working position into an inoperative position at which its path of movement never causes its cutting edge to raise above and cross the cutting edge of said fixed lower cutter.

2. A sewing machine according to claim 1, characterized in that the disengaging means comprises a latch lever which is articulated to a bracket piece by means of a pin.

3. A sewing machine according to claim 2, characterized in that a conical shaped end member is provided which acts against a wedge-like surface formed on said latch lever and which blocks the pivot movement of the latch lever in a releasable manner relative to the bracket piece.

4. A sewing machine according to claim 3, characterized in that said conical shaped end member is part of a piston which can move in a reciprocating manner in a hollow cylinder.

5. A sewing machine according to claim 4, characterized in that said piston is actuated in a manner controlled by compressed air.

6. A sewing machine according to claim 1, characterized in that said cutting means includes a shaft, an eccentric journal disposed on said shaft of the cutting means, such that drive can be derived from the said eccentric journal for said cutting means and also other sewing machine components.

7. A sewing machine according to claim 1, characteristic in that said sewing means includes a cylinder arm and said cutting means is disposed on said cylinder arm of the sewing machine.

8. A sewing machine according to claim 2, characterized in that said cutting means includes a shaft, an eccentric journal disposed on said shaft of the cutting means, such that drive can be derived from said eccentric journal for said cutting means and also other sewing machine components.

9. A sewing machine according to claim 3, characterized in that said cutting means includes a shaft, an eccentric journal disposed on said shaft of the cutting means, such that drive can be derived from said eccentric journal for said cutting means and also other sewing machine components.

10. A sewing machine according to claim 4, characterized in that said cutting means includes a shaft, an eccentric journal disposed on said shaft of the cutting means, such that drive can be derived from said eccentric journal for said cutting means and also other sewing machine components.

11. A sewing machine according to claim 5, characterized in that said cutting means includes a shaft, an eccentric journal disposed on said shaft of the cutting means, such that drive can be derived from said eccentric journal for said cutting means and also other sewing machine components.

* * * * *